US007782264B1

(12) United States Patent
Vincent

(10) Patent No.: US 7,782,264 B1
(45) Date of Patent: Aug. 24, 2010

(54) SYSTEMS AND METHODS FOR PROVIDING DISTRIBUTED LOAD MONOPOLE ANTENNA SYSTEMS

(75) Inventor: Robert J. Vincent, Warwick, RI (US)

(73) Assignee: The Board of Governors for Higher Education, State of Rhode Island and Providence Plantations, Providence, RI (US)

( * ) Notice: Subject to any disclaimer, the term of this patent is extended or adjusted under 35 U.S.C. 154(b) by 692 days.

(21) Appl. No.: 11/689,679

(22) Filed: Mar. 22, 2007

Related U.S. Application Data

(60) Provisional application No. 60/786,437, filed on Mar. 28, 2006.

(51) Int. Cl.
*H01Q 9/32* (2006.01)

(52) U.S. Cl. ..... 343/745; 343/749; 343/750

(58) Field of Classification Search ..... 343/722, 343/749, 752, 860, 750, 876
See application file for complete search history.

(56) References Cited

U.S. PATENT DOCUMENTS

| | | | | | |
|---|---|---|---|---|---|
| 2,311,472 | A | | 2/1943 | Roosenstein | |
| 3,445,849 | A | | 5/1969 | Sanford | |
| 3,521,169 | A | * | 7/1970 | Lindenmeier et al. | 455/129 |
| 3,689,928 | A | * | 9/1972 | Felsenheld | 343/703 |
| 3,909,830 | A | * | 9/1975 | Campbell | 343/703 |
| 3,967,276 | A | * | 6/1976 | Goubau | 343/752 |
| 3,984,839 | A | | 10/1976 | Ray, Jr. | |
| 4,095,229 | A | | 6/1978 | Elliott | |
| 4,229,743 | A | | 10/1980 | Vo et al. | |
| 4,442,436 | A | | 4/1984 | Newcomb | |
| 4,564,843 | A | | 1/1986 | Cooper | |
| 4,656,483 | A | * | 4/1987 | Jaquet | 343/745 |
| 4,734,703 | A | | 3/1988 | Nakase et al. | |
| 5,016,021 | A | | 5/1991 | Newcomb | |
| 5,065,164 | A | | 11/1991 | Deasy | |
| 5,134,419 | A | | 7/1992 | Egashira | |
| 5,406,296 | A | | 4/1995 | Egashira et al. | |
| 5,521,607 | A | | 5/1996 | Deasy | |
| 5,856,808 | A | | 1/1999 | Holshouser et al. | |
| 5,955,996 | A | | 9/1999 | Clubb | |

(Continued)

OTHER PUBLICATIONS

Harrison, Jr., "Monopole with Inductive Loading," IEEE Transactions on Antennas and Propagation, Sandia Corporation, Albuquerque, NM, Dec. 26, 1962, pp. 394-400.

(Continued)

*Primary Examiner*—Michael C Wimer
(74) *Attorney, Agent, or Firm*—Gauthier & Connors LLP

(57) ABSTRACT

A distributed load monopole antenna system is disclosed that includes a monopole antenna including a radiation resistance unit, a current enhancing unit, and a conductive mid-section. The radiation resistance unit is coupled to a transmitter base and the radiation resistance unit includes a radiation resistance unit base that is coupled to ground. The radiation resistance unit also includes a plurality of windings of an electrically conductive material wherein each winding includes an elongated portion that is substantially parallel with an elongated central axis of the monopole antenna. The elongated portions are positioned at a plurality of angularly disposed locations around the elongated central axis of the monopole antenna. The current enhancing unit is for enhancing current through the radiation resistance unit, and the conductive mid-section is intermediate the radiation resistance unit and the current enhancing unit.

25 Claims, 9 Drawing Sheets

U.S. PATENT DOCUMENTS

| | | | |
|---|---|---|---|
| 6,054,958 | A | 4/2000 | Holshouser et al. |
| 6,208,306 | B1 | 3/2001 | McLean et al. |
| 6,437,756 | B1 | 8/2002 | Schantz |
| 6,791,504 | B1 | 9/2004 | Miller et al. |
| 7,187,335 | B2 | 3/2007 | Vincent |

OTHER PUBLICATIONS

Fujimoto et al., "Small Antennas," Research Studies Press Ltd., Letchworth, Hertfordshire, England & John Wiley & Sons Inc., New York, 1987, pp. 59-75.

"Now You're Talking!: All You Need to Get Your First Ham Radio License," The American Radio Relay League, Inc., Second Edition, Apr. 1996, Chapter 7, pp. 16-17.

"The Offset Multiband Trapless Antenna (OMTA)," QST, vol. 79, No. 10, American Radio Relay League, Inc., 1996, pp. 1-11.

"Mounting Tips for the Stealth II Series HF Mobile Antennas," Version 3.32, Aug. 2002, pp. 1-9.

Nakano et al., "A Monofilar Spiral Antenna Excited Through a Helical Wire," IEEE Transactions of Antennas and Propagation, vol. 51, No. 3, Mar. 2003, pp. 661-664.

"Helix Antenna," http://library.kmitnb.ac.th/projects/eng/EE/ee0003e.html.

T. Simpson, "The Dick Loaded Monopole Antenna," IEEE Transactions of Antennas and Propagation, vol. 52, No. 2, Feb. 2004, pp. 542-545.

Hale, Bruce S. (Editor), "The ARRL Handbook for the Radio Amateur". pp. 33-15 through pp. 33-17. American Radio Relay League, 1989 Newington, US.

Rothammel, Karl, "Antennenbuch (8. Auflage)". p. 514, paragraph 28.1 through p. 525, paragraph 28.3. Telekosmos-Verlag Franckh'sche Verlagshandlung, 1984, Stuttgart, DE.

W5BIG: Antenna Analyzer AIM430, Bob Clunn, 2005, sheet 1-6 to 6-6.

* cited by examiner

50

| | Frequency MHz | SWR | R | X |
|---|---|---|---|---|
| 0 | 6.7000 | 6.2000 | 123.00 | 188.00 |
| 1 | 6.8000 | 4.3000 | 94.000 | 110.00 |
| 2 | 6.9000 | 2.6000 | 69.000 | 58.000 |
| 3 | 6.9250 | 2.3000 | 65.000 | 47.000 |
| 4 | 6.9500 | 2.1000 | 62.000 | 37.000 |
| 5 | 6.9750 | 1.8000 | 56.000 | 29.000 |
| 6 | 7.0000 | 1.4000 | 52.000 | 19.000 |
| 7 | 7.0250 | 1.3000 | 51.000 | 14.000 |
| 8 | 7.0500 | 1.0000 | 50.000 | 2.0000 |
| 9 | 7.0750 | 1.2000 | 48.000 | 8.0000 |
| 10 | 7.1000 | 1.4000 | 47.000 | 15.000 |
| 11 | 7.1250 | 1.6000 | 45.000 | 23.000 |
| 12 | 7.1500 | 1.8000 | 42.000 | 32.000 |
| 13 | 7.1750 | 2.2000 | 37.000 | 41.000 |
| 14 | 7.2000 | 2.5000 | 32.000 | 50.000 |
| 15 | 7.3000 | 4.5000 | 20.000 | 75.000 |
| 16 | 7.4000 | 6.9000 | 14.000 | 96.000 |
| 17 | 7.5000 | 9.8000 | 9.0000 | 114.00 |

FIG. 4

Measured field level variations 3.5 turn Tapped helix.
Levels in comparison to a normal Plano Spiral helix DLM operating at 7 MHz Figure 3 gain vs freq. Plano Spiral helix 3.5 turn

SYSTEMS AND METHODS FOR PROVIDING DISTRIBUTED LOAD MONOPOLE ANTENNA SYSTEMS

PRIORITY

The present application claims priority to U.S. Provisional Patent Application Ser. No. 60/786,437 filed Mar. 28, 2006.

BACKGROUND

The present invention generally relates to antennas, and relates in particular to antenna systems that include one or more monopole antennas.

Monopole antennas typically include a single pole that may include additional elements with the pole, including for example, additional monopole antennas. Non-monopole antennas generally include antenna structures that form two or three dimensional shapes such as diamonds, squares, circles etc.

As wireless communication systems (such as wireless telephones and wireless networks) become more ubiquitous, the need for smaller and more efficient antennas such as monopole antennas (both large and small) increases. Many monopole antennas operate at very low efficiency yet provide satisfactory results. In order to meet the demand for smaller and more efficient antennas, the efficiency of such antennas must improve.

Further, the adjustment or tuning of the operating frequency of an antenna is sometimes required. Such tuning, however, is typically available only over a small range. Adjustment of an antenna over a wide operating frequency range of, for example, up to 2:1 or more generally requires a number of antennas or requires base-loading (sometimes called base-tuning). Base-loading involves matching the antenna load presented to the transmitter by varying the antenna load. The efficiency of such systems, however, is generally low and radiation performance of such antennas will vary widely over the full tuning range of the antenna. Efficiency or antenna gain can vary widely from one end of this tuning range to the other.

For example, base-loaded antennas may have efficiency or gain from a high of 60% to a low of less than 10%. The lower gain is usually associated with the lowest frequency. An antenna with an efficiency or gain of 10% will radiate 1 Watt out of every 10 the transmitter loads into the tuner. This generally results in very robust tuner designs when high power is utilized. A 5 KW transmitter at an impedance of 50 Ohms will be capable of supplying 10 amps of average RF current operating in the continuous mode. This may range to peaks as high as 15 amps or more when amplitude modulation is used. If these 10 to 15 amps of RF current are transformed from 50 Ohms to an impedance that is much higher, then the tuner must be designed to withstand extremely either high voltages or high currents. Either way, it becomes a significant problem at higher power levels to control the antenna matching and maintain efficiency.

As mentioned above, a number of antennas may be used instead of the base-loading technique to achieve wide bandwidth operation. Such a multi-antenna system may include an antenna for each desired frequency. Each antenna may be designed to present a constant 50 Ohm load at the operating frequency confined within some bandwidth. Another alternative involves lengthening and shortening a common antenna by inserting and removing sections of tubing as needed or using a telescoping mast antenna. Telescoping mast antennas present problems in achieving the lowest and highest frequency of operation as the necessary steps for adjusting the antenna are time consuming and labor intensive. For example, for a ¼ wave monopole antenna this typically requires that the antenna be taken apart and re-assembled using longer sections There is a need, therefore, for more efficient and cost effective implementation of a monopole antenna, as well as other types of antennas and antenna systems, and there is a further need for an efficient and cost effective method for tuning such antenna systems. For example, there is a need in particular for a method of rapidly changing the antenna resonance to any desired frequency within its range and while maintaining a constant bandwidth to provide a constant 50 Ω, match to the transmission line connected to the transmitter or final amplifier. The mechanism for accomplishing this must have the capability of handling the large radio frequency current and transforming this into radiation by the antenna. It is desirable, for example, to provide an antenna designed for typical operation within the AM broadcast band of 535-1700 kHz, and to have a 30 kHz bandwidth (+/−15 kHz).

SUMMARY

The invention provides a distributed load monopole antenna system that includes a monopole antenna including a radiation resistance unit, a current enhancing unit, and a conductive mid-section. In accordance with an embodiment, the radiation resistance unit is coupled to a transmitter base and the radiation resistance unit includes a radiation resistance unit base that is coupled to ground. The radiation resistance unit also includes a plurality of windings of an electrically conductive material wherein each winding includes an elongated portion that is substantially parallel with an elongated central axis of the monopole antenna. The elongated portions are positioned at a plurality of angularly disposed locations around the elongated central axis of the monopole antenna. The current enhancing unit is for enhancing current through the radiation resistance unit, and the conductive mid-section is intermediate the radiation resistance unit and the current enhancing unit.

In accordance with another embodiment, the radiation resistance unit is coupled to ground via a first plurality of selectively actuatable switches, and is coupled to a signal conductor via a second plurality of selectively actuatable switches such that both the first and second plurality of switches may be actuated to change an effective number of windings of the radiation resistance unit.

In accordance with a further embodiment, the radiation resistance unit includes a plurality of switches that may be selectively activated to change an effective number of windings of the radiation resistance unit, and the system further includes a wireless receiver coupled to an antenna analyzer for selectively activating the plurality of switches to change the effective number of windings of the radiation resistance unit responsive to signals received by the wireless receiver.

BRIEF DESCRIPTION OF THE DRAWINGS

The following description may be further understood with reference to the accompanying drawings in which:

FIG. 4 shows a table of standing wave ratio values (SWR) versus frequency for a system in accordance with an embodiment of the invention;

The drawings are shown for illustrative purposes only.

DETAILED DESCRIPTION

A distributed loaded monopole antenna may include a radiation resistance unit for providing significant radiation resistance, and a current enhancing unit for enhancing the current through the radiation enhancing unit as disclosed, for example in U.S. Pat. No. 7,187,335, the disclosure of which is hereby incorporated by reference. The radiation resistance unit may include a coil in the shape of a helix, and the current enhancing unit may include load coil and/or a top unit formed as a coil or hub and spoke arrangement. The radiation resistance unit is positioned between the current enhancing unit and a base (e.g., ground), and may, for example, be separated from the current enhancing unit by a distance of $2.5316\times10^{-2}\lambda$ where $\lambda$ is the operating frequency of the antenna, to provide a desired current distribution over the length of the antenna.

Figure 1:
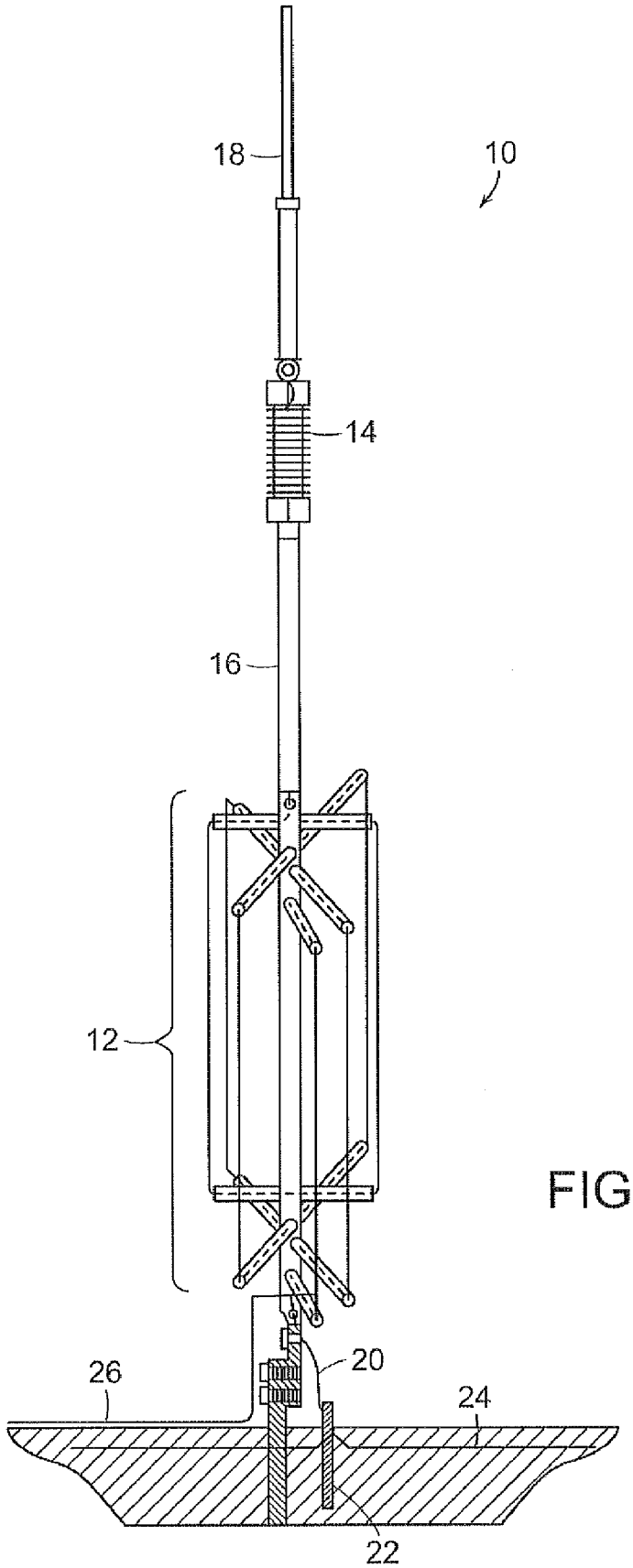
FIG. 1 shows an illustrative diagrammatic view of a distributed load monopole antenna system in accordance with an embodiment of the invention.

As shown in FIG. 1, a diagrammatic view of an antenna system 10 of the invention includes a radiation resistance unit 12 and a current enhancing unit 14. The radiation resistance unit 12 is formed of a three-dimensional cage structure as discussed in more detail below.

The current enhancing unit 14 (such as, for example, a load coil) may be formed of a variety of conductive materials and may be formed in a variety of shapes. The unit 14 is positioned above the unit 12 and is separated a distance above the unit 12 and supported by a conductive mid-section 16 (e.g., aluminum tubing). The current enhancing unit 14 when placed a distance above the radiation resistance unit 12 performs several important functions. These functions include raising the radiation resistance of the helix and the overall antenna. The antenna system 10 also includes a conductive top section 20. Each winding, therefore, includes an elongated portion that is substantially parallel with the elongated central axis of the monopole antenna. The elongated portions of each winding positioned at a plurality of angularly disposed locations around the elongated central axis of the monopole antenna.

Figure 2:
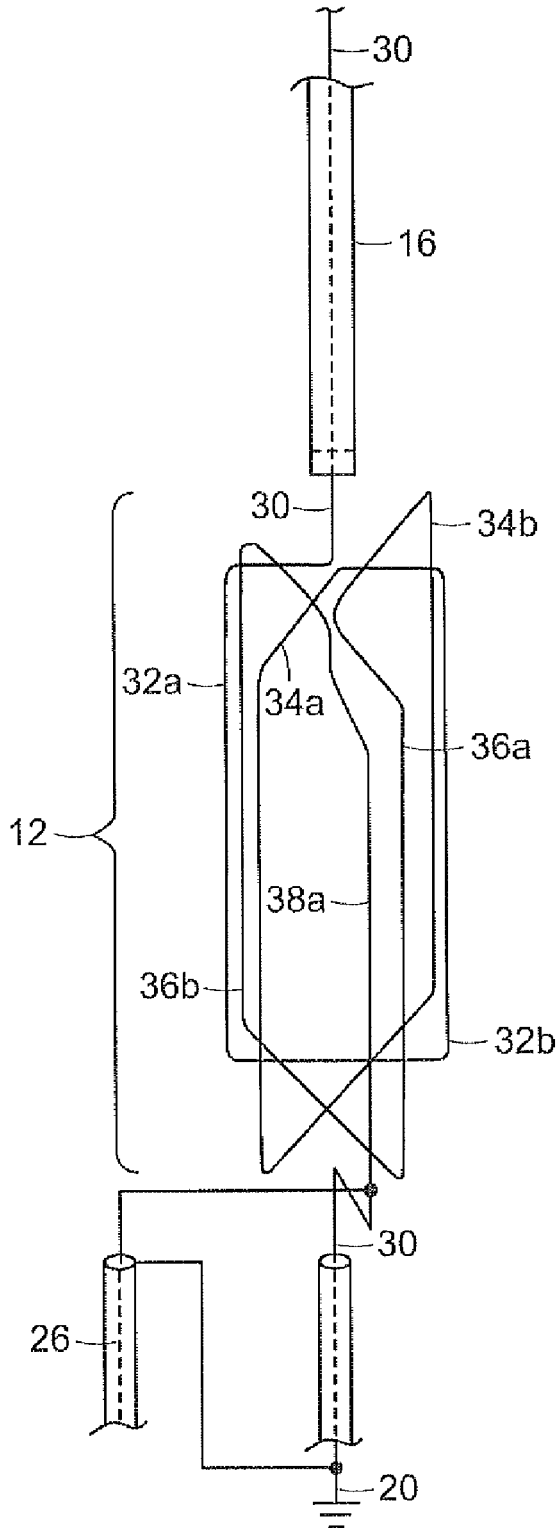
FIG. 2 shows an illustrative diagrammatic circuit of a portion of the distributed load monopole antenna shown in FIG. 1.

The antenna provides continuous electrical continuity from the base of the antenna to the top of the antenna conductive metal 18. The base of the antenna is grounded by a ground wire 20 coupled to a ground post 22 and spoke-like ground wires 24. The signal to be transmitted may be provided by a coaxial cable 26 at any point along the radiation resistance unit 12 (e.g., near but not at the bottom of the unit 12). The signal may also be optionally passed through a capacitor in certain embodiments to tune out excessive inductive reactance in certain embodiments. The signal conductor of the coaxial cable 26 is coupled to one of the lower radiation resistance unit windings near the base as shown in FIG. 2, and the outer conductor of the coaxial cable is coupled to ground as also shown in FIG. 2. FIG. 2 shows an illustrative diagrammatic view of the circuit of a portion of the antenna shown in FIG. 1. As shown in FIG. 2, a single conductor 30 extends from the mid-section 16, through a plurality of three-dimensional windings in the radiation resistance unit 12, and is ultimately grounded at the base of the antenna. The outer conductor of a coaxial conductor 26 is also grounded, with the transmission signal being delivered from the center of the coaxial conductor 26 to a tap along a winding of the radiation resistance unit 12.

The choice of the distance of the load coil above the helix impacts the average current distribution along the length of the antenna. The average current distribution over the length of the antenna varies as a function of the mid-section distance for a 7 MHz distributed loaded monopole antenna. The conductive mid-section has a length that provides that a sufficient average current is provided over the length of the antenna and provides for increasing radiation resistance.

The inductance of the load coil should be larger than the inductance of the radiation resistance unit. For example, the ratio of load coil inductance to radiation resistance unit inductance may be in the range of about 1.1 to about 2.0, and may preferably by about 1.4 to about 1.7. In addition to providing an improvement in radiation efficiency of a radiation resistance unit and the antenna as a whole, placing the load coil above the radiation resistance unit for any given location improves the bandwidth of the antenna as well as improves the radiation current profile. The radiation resistance unit and load coil combination are responsible for decreasing the size of the antenna while improving the efficiency and bandwidth of the overall antenna. In further embodiments, a top unit may be include a top section (e.g., one or more conductive spokes) that extends from the upper portion of the antenna above the conductive section 18 in a radial direction that is orthogonal to the vertical axis of the antenna itself. The use of such a top unit may further reduce the inductive loading of the radiation resistance unit and load coil to allow even wider bandwidth and greater efficiency. The top unit is included as part of the current enhancing unit. In further embodiments, the top unit may be used in place of the load coil as the current enhancing unit.

The radiation resistance unit 12 of the system of FIGS. 1 and 2 provides a wider bandwidth than a distributed monopole antenna system as disclosed in U.S. Pat. No. 7,187,335 that includes a helix as a radiation resistance unit. As shown in FIGS. 1 and 2, the radiation resistance unit 12 includes vertically extending windings that are positioned radially from the center axis of the antenna. In particular, the conductor 30 extends from the mid-section 16 down winding 32*a*, up winding 32*b*, down winding 34*a*, up winding 34*b*, down winding 36*a*, up winding 36*b* and finally down winding 38*a*. The radiation resistance unit 12, therefore, is wound from top to bottom rather than around in a spiral or helix. In accordance with various embodiments, the windings may include any number of return windings such as two and one half windings or three and one half windings (three and one half are shown in FIGS. 1 and 2). The return path may also be provided as a ½ winding (as shown at 38*a*), or may be provided along the antenna axis.

A radiation resistance unit of the invention was implemented on a 30 meter radial system or radial lengths of about 15 feet. The frequency of the test was 7.0 MHz. These radials are about half of the normal length and also half the normal numbers of radials were employed. The field level measured in comparison to the conventional three dimensional helix distributed load monopole antenna at 7.0 MHz was +1.5 db better for the radiation resistance unit design of the above embodiment. This indicates that the radiation resistance unit of embodiments of the invention will provide better performance over marginal ground systems than will a conventional distributed load monopole antenna that includes a helix for the radiation resistance unit.

Figure 3:
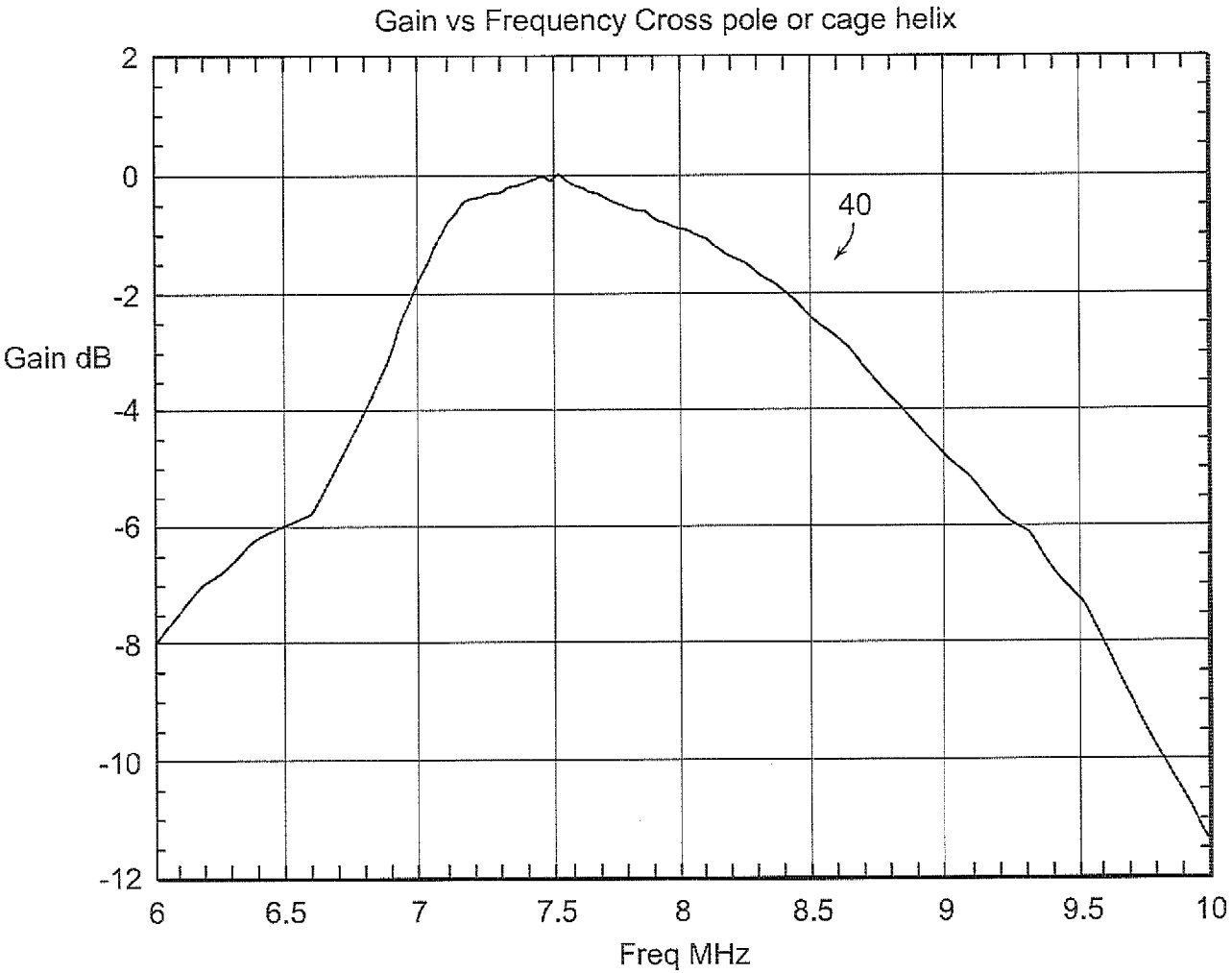
FIG. 3 shows the gain versus frequency for an operating frequency range of a system in accordance with an embodiment of the invention.
Figure 5:
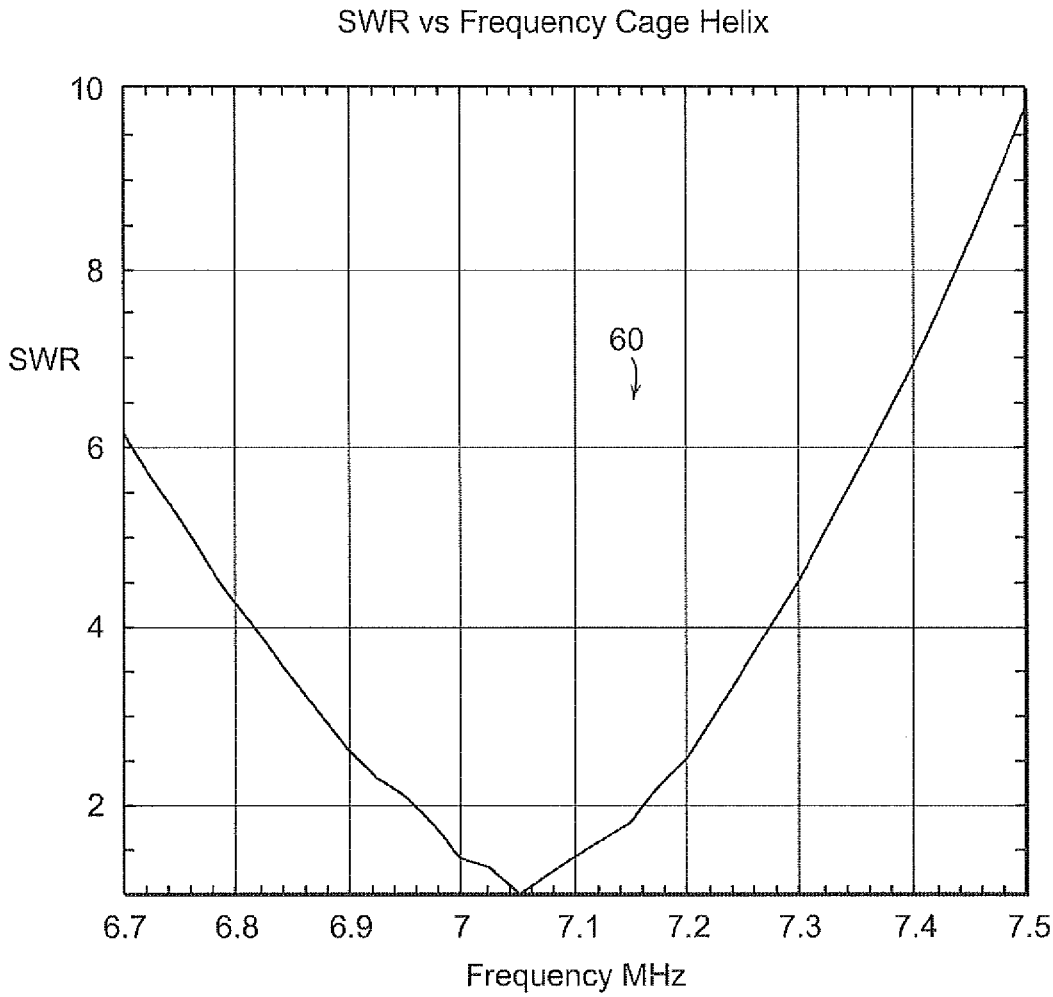
FIG. 5 shows a diagrammatic graphical view of the data shown in FIG. 4.

FIG. 3 shows at 40 the relationship of gain as a function of frequency for a system in accordance with an embodiment of the invention. Even with a high standing wave ratio (SWR) the antenna still provides good radiation efficiency. FIG. 4 shows at 50 data for the SWR as a function of frequency for a portion of the frequency range shown in FIG. 3. FIG. 5 shows at 60 the relationship of SWR as a function of frequency for a system in accordance with an embodiment of the invention.

In accordance with a further embodiment, the invention also provides a system and method for tuning a distributed load monopole antenna in accordance with an embodiment of the invention. Distributed load monopole antennas are normally designed to operate within a specific bandwidth as defined by the center frequency of the antenna design. These parameters are determined by the size of the antenna and values of inductance for the helix and load coil. With the helix radiation resistance units it is difficult to vary inductance and thus vary center operating frequency. Although certain adjustment methods exist for adjusting a distributed load monopole antenna, such adjustment methods generally provide frequency variation of the antenna operation as much as 20%. The proposed method of changing the inductance of the radiation resistance unit when combined with the variable top section adjustment allows continuous frequency variations of the antenna operation by, in some cases by more than four octaves. For example a 7 MHz spiral distributed load monopole antenna using these methods allowed operation from less than 6 MHz to higher than 18 MHz. This is a change in frequency of better than three octaves or more than 300%. In addition, operation of the antenna at higher frequencies results in as much as +6 db higher gain than could be achieved with a comparable antenna designed for a single frequency of operation.

Figure 6:
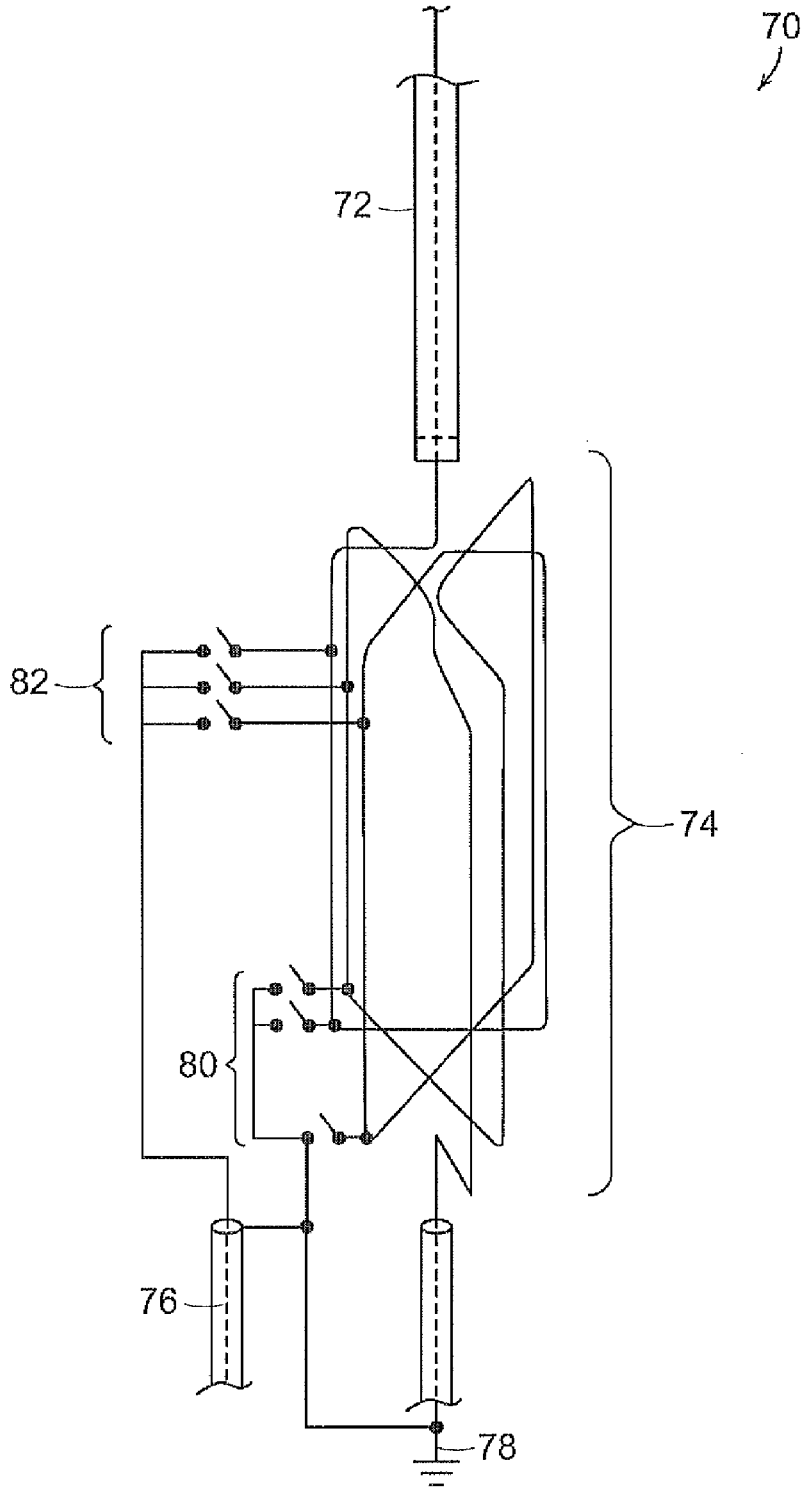
FIG. 6 shows a diagrammatic illustrative view of a system in accordance with another embodiment of the invention that provides adjustment of the antenna operating parameters.

FIG. 6 shows at 70 a system in accordance with a further embodiment of the invention in which a distributed load monopole antenna includes a mid-section 72, an adjustable radiation resistance unit 74, a coaxial cable connector 76 and a ground connection 78. The adjustable radiation resistance unit 74 includes winding as discussed above with reference to FIGS. 1 and 2, but also include a plurality of switches that are coupled to the windings. In particular, switches 80 govern which winding will terminate at ground, and switches 82 govern which winding will be coupled to the signal from the coaxial connector 76. By combing the actuation of the switches, the effective number of windings of the radiation resistance unit 74 may be changed, for example from three and one half windings to two and one half windings.

Figure 7:
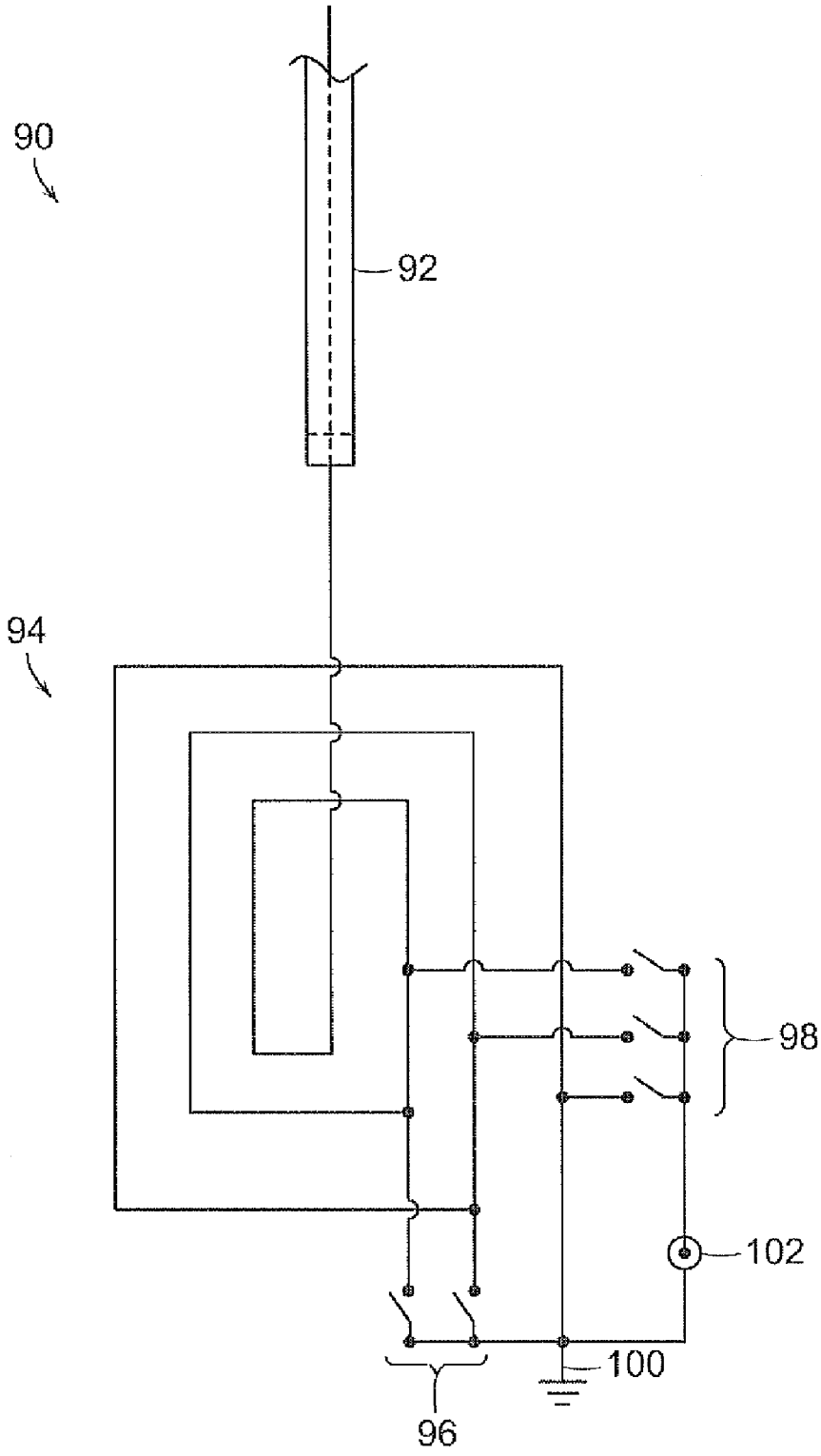
FIG. 7 shows a diagrammatic illustrative view of a system in accordance with a further embodiment of the invention employing a piano-spiral helix that provides adjustment of the antenna operating parameters.
Figure 8:
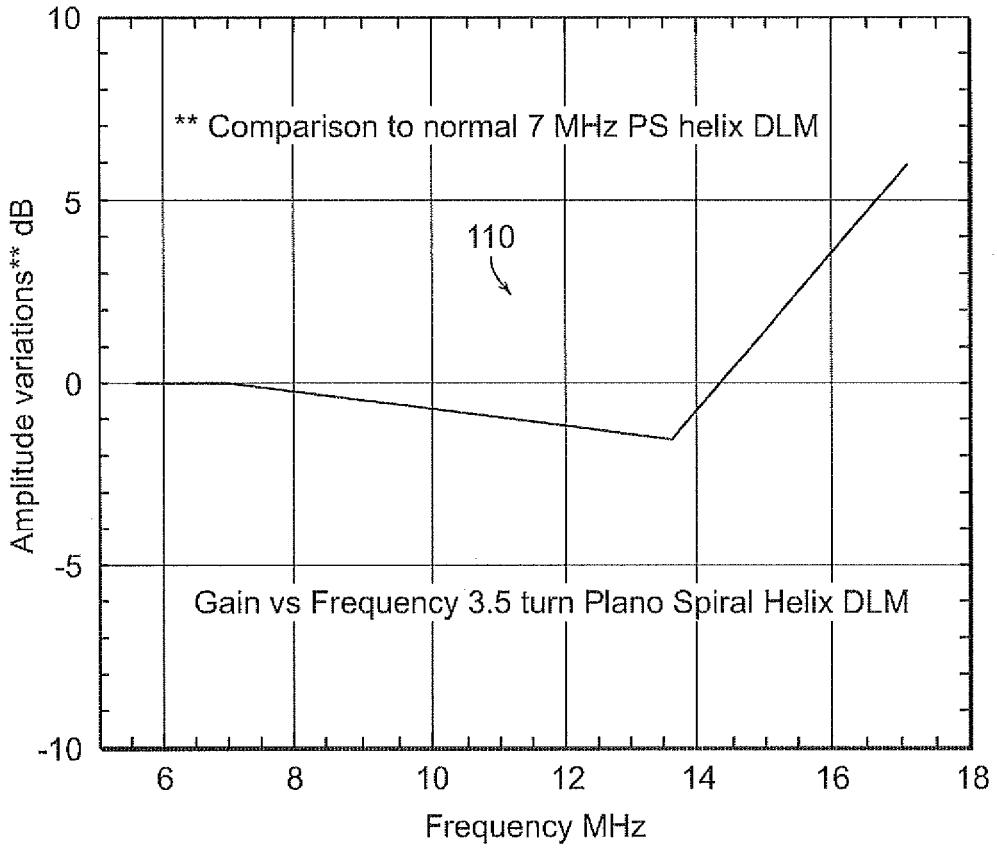
FIG. 8 shows a diagrammatic graphical view of measured field level amplitudes versus frequency for a system in accordance with an embodiment of the invention.

As shown at 90 in FIG. 7, an adjustable radiation resistance unit in accordance with an embodiment of the invention may also be provided as a plano spiral. The system 90 includes a mid-section 92, piano-spiral radiation resistance unit 94, a plurality of switches 96 that govern which winding will terminate at ground 100, and a plurality of switches 98 that govern which winding will be coupled to the signal from the coaxial connector 102.

A non-adjustable piano-spiral radiation resistance unit is generally designed with two and one half turns of a conductive metal. This may be wire, tubing, metal strap or a copper trace of a printed wiring board. In the embodiment shown in FIG. 7, a 2.5 turn of wire helix is changed and made of 3.5 turns. This allows lower frequency of operation with slight decrease in the level of higher end of its frequency range. As shown, various turns of the helix are shorted to ground and the antenna feed point is also changed. This allows very coarse variations of the antenna operating frequency. In order to fill in the gaps of this coarse frequency change the top section is varied in length. In some cases the load coil is also changed by tapping the number of turn used for each application. The variation of all three of these parameters allows a continuous frequency change in the antenna operation. For each variation of these three parameters there exists a defined bandwidth that the antenna will still operate over with no changes being made to any of the previously described antenna elements. The present embodiment, therefore, provides a method of changing the operating frequency of the antenna without sacrificing any level of performance.

Figure 9:
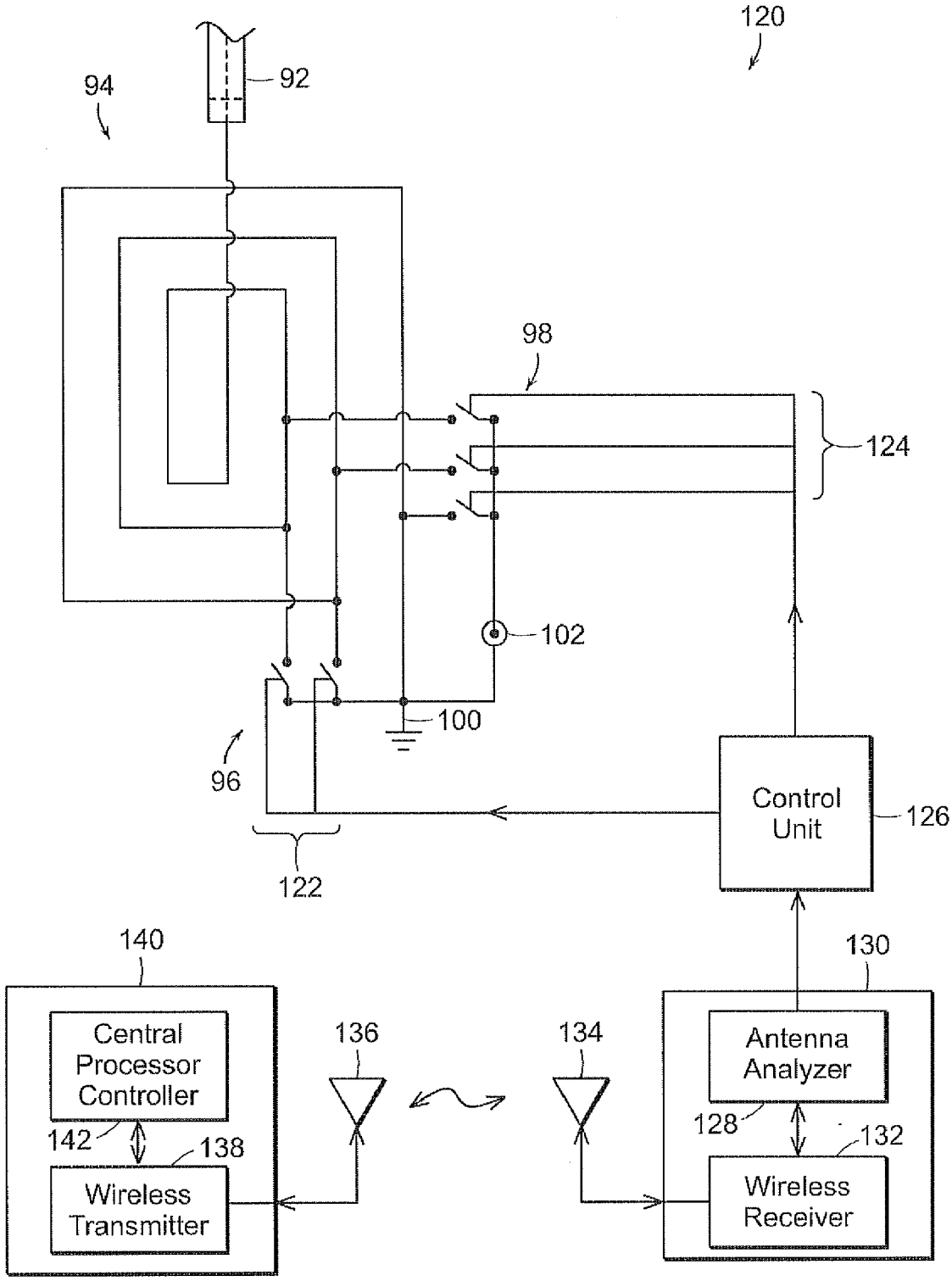
FIG. 9 shows a diagrammatic illustrative view of a system in accordance with a further embodiment of the invention.

In accordance with a further embodiment, the invention provides an adaptive smart antenna system in which switches as discussed above are controlled by a wireless control system. As shown in FIG. 9, such a system 120 may include an adjustable radiation resistance unit as discussed above with reference to FIG. 7 that includes the mid-section 92, the piano-spiral radiation resistance unit 94, the plurality of switches 96 that govern which winding will terminate at ground 100, and the plurality of switches 98 that govern which winding will be coupled to the signal from the coaxial connector 102.

As shown in FIG. 9, the system further includes control signal connectors 122 for controlling the switches 96, and control signal connectors for controlling the switches 98, as well as an antenna switch control unit 126 for providing the control signals to the switches 96 and 98. The control unit 126 receives its instructions from an antenna analyzer 128 of a remote control device 130, and the antenna analyzer 128 receives its command signals from a wireless receiver 132. The wireless receiver 132 is coupled to an antenna 134 and receives signals from an antenna 136 that is coupled to a transmitter 138 of a central control device 140. The transmitter 138 is also coupled to a central processor controller 142. The antenna analyzer 128 may be, for example, an AIM430 Antenna Analyzer Interface product as sold by W5BIG of Richardson, Tex.

The central processor controller 142 generates the command instructions for the control of the switches for both the ground termination (switches 96) and the tap points on the windings (switches 98). These instructions are sent via the transmitter 138 to the receiver 132 of the remote control device 130, and the control unit 126 causes the switches to be adjusted in accordance with the instructions as determined to be necessary by the antenna analyzer 128.

This invention therefore provides for the development of an Adaptive Smart Antenna (ASA) in accordance with the present embodiment that has many applications in cellphones and wireless systems. In addition, antennas in accordance with various embodiments of the invention may be used in medical applications for patient monitoring. Further commercial applications may include the use of these inventions for development of antenna arrays for use in high frequency radar used to measure sea and ocean states and to predict the occurrence of tsunamis, as well as to measure ocean and river currents.

This control system permits distributed load monopole antennas, whether alone or in a multi-antenna system, to be controlled in real time. Current antenna tuning control and frequency changing allows for manipulation of one set of antenna parameters and/or selection of individual antennas as needed. The system described herein allows not just selection and control of one or two antenna parameters but a whole range of parameters and/or antennas without one physical connection to the antenna. The system permits the control and variation of antenna parameters for changing antenna frequency and performance of a single antenna as well as any number of antennas that, for example, form arrays of antennas.

Those skilled in the art will appreciate that numerous modifications and variations may be made to the above disclosed embodiments without departing from the spirit and scope of the invention.

What is claimed is:

1. A distributed load monopole antenna system including a monopole antenna comprising:

a radiation resistance unit coupled to a transmitter base, said radiation resistance unit including a radiation resistance unit base that is coupled to ground, and including a plurality of windings of an electrically conductive material wherein each winding includes an elongated portion that is substantially parallel with an elongated central axis of the monopole antenna, and wherein the elongated portions are positioned at a plurality of angularly disposed locations around the elongated central axis of the monopole antenna;

a current enhancing unit for enhancing current through said radiation resistance unit; and a conductive mid-section intermediate said radiation resistance unit and said current enhancing unit.

2. The distributed load monopole antenna system as claimed in claim 1, wherein said radiation resistance unit includes a one half winding that terminates at the radiation resistance unit base.

3. The distributed load monopole antenna system as claimed in claim 1, wherein said radiation resistance unit includes at least two and one half windings.

4. The distributed load monopole antenna system as claimed in claim 1, wherein said radiation resistance unit is coupled to ground via a first plurality of selectively actuatable switches.

5. The distributed load monopole antenna system as claimed in claim 4, wherein said first plurality of selectively actuatable switches are controlled by an antenna control unit that is coupled to a wireless receiver.

6. The distributed load monopole antenna system as claimed in claim 1, wherein said radiation resistance unit is coupled to a signal conductor via a second plurality of selectively actuatable switches.

7. The distributed load monopole antenna system as claimed in claim 6, wherein said second plurality of selectively actuatable switches are controlled by an antenna control unit that is coupled to a wireless receiver.

8. The distributed load monopole antenna system as claimed in claim 1, wherein said radiation resistance unit is coupled to ground via a first plurality of selectively actuatable switches, and wherein said radiation resistance unit is coupled to a signal conductor via a second plurality of selectively actuatable switches such that both said first and second plurality of switches may be actuated to change the effective number of windings of the radiation resistance unit.

9. The distributed load monopole antenna system as claimed in claim 8, wherein said first plurality of selectively actuatable switches and said second plurality of selectively actuatable switches are controlled by an antenna control unit that is coupled to a wireless receiver.

10. A distributed load monopole antenna system including a monopole antenna comprising:

a radiation resistance unit coupled to a transmitter base, said radiation resistance unit including a radiation resistance unit base that is coupled to ground, wherein said radiation resistance unit is coupled to ground via a first plurality of selectively actuatable switches, and wherein said radiation resistance unit is coupled to a signal conductor via a second plurality of selectively actuatable switches such that both said first and second plurality of switches may be actuated to change an effective number of windings of the radiation resistance unit, wherein said first plurality of selectively actuatable switches and said second plurality of selectively actuatable switches are controlled by an antenna control unit that is coupled to a wireless receiver;

a current enhancing unit for enhancing current through said radiation resistance unit; and a conductive mid-section intermediate said radiation resistance unit and said current enhancing unit.

11. The distributed load monopole antenna system as claimed in claim 10, wherein said radiation resistance unit includes a plurality of windings of an electrically conductive material wherein each winding includes an elongated portion that is substantially parallel with an elongated central axis of the monopole antenna, and wherein the elongated portions are positioned at a plurality of angularly disposed positions around the elongated central axis of the monopole antenna.

12. The distributed load monopole antenna system as claimed in claim 11, wherein said radiation resistance unit includes a one half winding that terminates at the radiation resistance unit base.

13. The distributed load monopole antenna system as claimed in claim 11, wherein said radiation resistance unit includes at least two and one half windings.

14. The distributed load monopole antenna system as claimed in claim 11, wherein said first plurality of selectively actuatable switches and said second plurality of selectively actuatable switches may be actuated to provide that the radiation resistance unit includes either two and one half windings or three and one half windings.

15. The distributed load monopole antenna system as claimed in claim 10, wherein said system includes a plurality of distributed load monopole antennas.

16. A distributed load monopole antenna system including a monopole antenna comprising:

a radiation resistance unit coupled to a transmitter base, said radiation resistance unit including a radiation resistance unit base that is coupled to ground, wherein said radiation resistance unit includes a plurality of switches that may be selectively activated to change an effective number of windings of the radiation resistance unit;

a current enhancing unit for enhancing current through said radiation resistance unit;

a conductive mid-section intermediate said radiation resistance unit and said current enhancing unit; and a wireless receiver coupled to an antenna analyzer for selectively activating the plurality of switches to change the effective number of windings of the radiation resistance unit responsive to signals received by the wireless receiver.

17. A distributed load monopole antenna system as claimed in claim 16, wherein said plurality of switches includes a first plurality of selectively actuatable switches by which said radiation resistance unit is coupled to ground, and a second plurality of selectively actuatable switches by which said radiation resistance unit is coupled to a signal conductor.

18. The distributed load monopole antenna system as claimed in claim 17, wherein said first plurality of selectively actuatable switches and said second plurality of selectively actuatable switches may be actuated to provide that the radiation resistance unit includes either two and one half windings or three and one half windings.

19. The distributed load monopole antenna system as claimed in claim 16, wherein said radiation resistance unit includes a plurality of windings of an electrically conductive material wherein each winding includes an elongated portion that is substantially parallel with an elongated central axis of the monopole antenna, and wherein the elongated portions are positioned at a plurality of angularly disposed positions around the elongated central axis of the monopole antenna.

20. A distributed load monopole antenna system including a monopole antenna comprising:

a radiation resistance unit coupled to a transmitter base, said radiation resistance unit including a radiation resistance unit base that is coupled to ground, wherein said radiation resistance unit is coupled to ground via a first plurality of selectively actuatable switches, and wherein said radiation resistance unit is coupled to a signal conductor via a second plurality of selectively actuatable switches such that both said first and second plurality of switches may be actuated to change an effective number of windings of the radiation resistance unit, wherein said radiation resistance unit includes a plurality of windings of an electrically conductive material wherein each winding includes an elongated portion that is substantially parallel with an elongated central axis of the monopole antenna, and wherein the elongated portions are positioned at a plurality of angularly disposed positions around the elongated central axis of the monopole antenna;

a current enhancing unit for enhancing current through said radiation resistance unit; and a conductive mid-section intermediate said radiation resistance unit and said current enhancing unit.

21. The distributed load monopole antenna system as claimed in claim 20, wherein said first plurality of selectively actuatable switches and said second plurality of selectively actuatable switches are controlled by an antenna control unit that is coupled to a wireless receiver.

22. The distributed load monopole antenna system as claimed in claim 20, wherein said radiation resistance unit includes a one half winding that terminates at the radiation resistance unit base.

23. The distributed load monopole antenna system as claimed in claim 20, wherein said radiation resistance unit includes at least two and one half windings.

24. The distributed load monopole antenna system as claimed in claim 20, wherein said first plurality of selectively actuatable switches and said second plurality of selectively actuatable switches may be actuated to provide that the radiation resistance unit includes either two and one half windings or three and one half windings.

25. The distributed load monopole antenna system as claimed in claim 20, wherein said system includes a plurality of distributed load monopole antennas.

* * * * *